US007849683B2

(12) United States Patent
Asame et al.

(10) Patent No.: US 7,849,683 B2
(45) Date of Patent: Dec. 14, 2010

(54) MULTIPLE-CYLINDER INTERNAL COMBUSTION ENGINE HAVING CYLINDER HEAD PROVIDED WITH CENTRALIZED EXHAUST PASSAGEWAY

(75) Inventors: Koichiro Asame, Saitama (JP); Yuusuke Wada, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 1016 days.

(21) Appl. No.: 11/648,895

(22) Filed: Jan. 3, 2007

(65) Prior Publication Data

US 2010/0251704 A1 Oct. 7, 2010

(30) Foreign Application Priority Data

Jan. 13, 2006 (JP) ..... 2006-006572

(51) Int. Cl.
*F01P 3/02* (2006.01)
*F02F 1/38* (2006.01)
*F02F 1/42* (2006.01)

(52) U.S. Cl. ..... 60/323; 123/41.82 R; 123/193.1

(58) Field of Classification Search ..... 60/321–324; 123/41.82 R, 193; 29/890.08
See application file for complete search history.

(56) References Cited

U.S. PATENT DOCUMENTS 4,086,762 A * 5/1978 Sakurai et al. ..... 60/282
4,993,227 A * 2/1991 Nagura et al. ..... 60/605.1
5,572,868 A * 11/1996 Okamoto et al. ..... 60/323
2002/0083703 A1* 7/2002 Werth et al. ..... 60/323

FOREIGN PATENT DOCUMENTS

JP 2002-070551 A 3/2002
JP 2005-188351 * 7/2005

* cited by examiner

*Primary Examiner*—M. McMahon
(74) *Attorney, Agent, or Firm*—Arent Fox, LLP

(57) ABSTRACT

A cylinder head 2 for a multiple-cylinder internal combustion engine is provided with a centralized exhaust passageway E. The centralized exhaust passageway E includes individual exhaust passageways 51 to 54 connected to combustion chambers defined by recesses 11 to 14, and a central passageway 60 collecting the exhaust gas flowing through the individual exhaust passageways 51 to 54. Each of the exhaust passageways 51 to 54 has two branch passageways 21, 31; 22,32; 23,33; 24,34 extending from the exhaust ports Ea opened and closed by exhaust valves 6, and a merging passageway 41; 42; 43; 44 having one end connected to the two branch passageways. The respective passage diameters D1 to D4 of the merging passageways 41 to 44 are substantially equal to the passage diameters d1 to d4 of the branch passageways. The merging passageways 41 to 44 and the central collecting passageway 60 are surrounded with water jackets W1 and W2 from above and below. Thus exhaust gas cooling efficiency can be improved without enlarging the cylinder head provided with the centralized exhaust passage.

3 Claims, 3 Drawing Sheets

MULTIPLE-CYLINDER INTERNAL COMBUSTION ENGINE HAVING CYLINDER HEAD PROVIDED WITH CENTRALIZED EXHAUST PASSAGEWAY

BACKGROUND OF THE INVENTION

1. Field of the Invention

The present invention relates to a multiple-cylinder internal combustion engine provided with cylinders and having a cylinder head provided with a centralized exhaust passageway for collecting the exhaust gas discharged from combustion chambers corresponding to the cylinders.

2. Description of the Related Art

A multiple-cylinder internal combustion engine having a cylinder head provided with a centralized exhaust passageway and not having an exhaust manifold is disclosed in JP-A 2002-70551. In this known multiple-cylinder internal combustion engine, the exhaust gas discharged from the combustion chambers corresponding to the cylinders is collected in the centralized exhaust passageway formed in the cylinder head.

In the multiple-cylinder internal combustion engine having the cylinder head provided with such centralized exhaust passageway, the exhaust gas flowing through the centralized exhaust passageway can be efficiently cooled by using a water jacket having a large capacity for cooling walls defining the combustion chambers. Omission of an expensive exhaust manifold reduces the cost of the multiple-cylinder internal combustion engine. There is a growing tendency for the temperature of the exhaust gas to increase with the continuous increase in the output power of the internal combustion engine. Thus the reduction of the temperature of the exhaust gas is still important. Increase of the capacity of the water jacket may be a possible measure for efficiently cooling the exhaust gas. However, increase in the capacity of the water jacket involves increase in the size of the cylinder head. On the other hand, it is desired to avoid the reduction of the output of the internal combustion engine attributable to the improvement of cooling efficiency as far as possible.

SUMMARY OF THE INVENTION

The present invention has been made in view of such circumstances and it is therefore an object of the present invention to improve the efficiency of cooling the exhaust gas without increasing the size of the cylinder head of a multiple-cylinder internal combustion engine.

Another object of the present invention is to enhance the output of a multiple-cylinder internal combustion engine.

The present invention provides a multiple-cylinder internal combustion engine comprising:

a cylinder block provided with a predetermined number of cylinders not less than two cylinders arranged in a predetermined cylinder arranging direction; and a cylinder head attached to the cylinder block so as to form combustion chambers respectively corresponding to the cylinders, said cylinder head having exhaust ports respectively opening into the combustion chambers for being opened and closed by exhaust valves, respectively, individual exhaust passageways respectively connected to the exhaust ports such that the exhaust gas discharged through the exhaust ports flows through the individual exhaust passageways, and a central collecting passageway for collecting the exhaust gas from the individual exhaust passageways;

wherein each of the individual exhaust passageways has a plurality of branch passageways connected to the exhaust ports opening into the combustion chamber and to be opened and closed by the exhaust valves, and a merging passageway having an upstream end joined to the plurality of branch passageways, the merging passageway has a passage diameter substantially equal to that of the branch passageways, and the merging passageway and the central collecting passageway are surrounded by water jackets from above and below.

When the merging passageways have a passage diameter smaller than that of known merging passageways, the capacity of the water jackets surrounding the merging passageways and the central passageway from above and below can be increased without changing the height of the cylinder head. Further, the distance between the center axes of the merging passageways and the water jackets can be made short, the exhaust gas flowing through the merging passageway can be entirely cooled to the central portion thereof. Since the passage diameter of the merging passageways is reduced, the lengths of partition walls each separating adjacent merging passageways can be increased and the length of the merging passageways can be increased accordingly. Thus the exhaust gas flowing through the merging passageways can be efficiently cooled.

The present invention has the following effects. The capacity of the water jackets surrounding the merging passageways and the central collecting passageway from above and below can be increased without changing the height of the cylinder head, the effect of cooling the exhaust gas flowing through the merging passageways can be enhanced, and hence the efficiency of cooling the exhaust gas discharged from the central collecting passageway is improved.

The multiple-cylinder internal combustion engine may comprise partition walls separating the merging passageways adjacent to each other with respect to the cylinder arranging direction, the partition walls having downstream ends at positions adjacent to an exit end of the central collecting passageway with respect to a direction parallel to axes of the cylinders, the downstream ends being arranged on a straight line parallel to the cylinder arranging direction.

With this configuration, the merging passageways can be formed in the longest possible length because all the partition walls extend to positions near the exit end of the central collecting passageway. Therefore, cooling of the exhaust gas in the merging passageways can be promoted. Exhaust gas interference can be reduced because the distance between each combustion chamber and the downstream end of each individual exhaust passageway is made long.

This provides the following effect. Since the cooling effect of the merging passageways is enhanced, the efficiency of cooling the exhaust gas flowing through the centralized exhaust passageway can be improved and exhaust gas interference can be reduced. Thus exhaust efficiency improves and engine output increases.

Preferably, the predetermined number of individual exhaust passageways include first and second end individual exhaust passageways at opposite ends, respectively, of the arrangement of the individual exhaust passageways, and at least one intermediate individual exhaust passageway arranged in the cylinder arranging direction between the first and second end individual exhaust passageways, and wherein points of intersection of extensions of center axes of the merging passageways of the first and second end individual exhaust passageways and the exit end of the central collecting passageway are nearer to the first and second end individual exhaust passageways, respectively, than a point of intersection of an extension of center axis of the merging passageway of the at least one intermediate individual exhaust passageway and the exit end of the central collecting passageway with respect to the cylinder arranging direction.

With such configuration, the exhaust gas flowing through the end individual exhaust passageways can more easily flow out through the exit than the exhaust gas flows out from the central passageway substantially along the exit of the central collecting passageway, the influence of the flow of the exhaust gas flowing through the end individual exhaust passageways on the flow of the exhaust gas flowing through the intermediate individual exhaust passageways is reduced, and the exhaust gas can smoothly outflow through the exit.

This configuration provides the following effect. Since the exhaust gas can easily outflow through the individual exhaust passageways, exhaust efficiency improves and engine output increases.

In a preferred embodiment of the present invention, partition walls are provided to separate the merging passageways adjacent to each other with respect to the cylinder arranging direction, the central collecting passageway has an exit, and a maximum distance between downstream ends of the partition walls and the exit of the central collecting passageway, with respect to a direction parallel to axes of the cylinders, is not greater than a passage diameter of the merging passageways.

Thus the merging passageways can be formed in an increased length and exhaust gas interference can be effectively reduced even if the adjacent cylinders are successive in ignition order and the ignition periods of the adjacent cylinders overlap each other.

In a preferred form of the present invention, the central collecting passageway has an exit having a center corresponding to substantially a middle part, with respect to the cylinder arranging direction, of a side wall on an exhaust side of the cylinder head, and the merging passageways are extended straight so as to converge toward the exit.

In this case, the straight merging passageways reduce resistance against the flow of the exhaust gas. Since the straight merging passageways of a small diameter are extended so as to converge toward and on the exit formed in the middle part of the side wall on the exhaust side of the cylinder head, the cylinder head can be given a small size and the capacity of the water jackets can be increased accordingly.

In another preferred form of the present invention, the central collecting passageway has an exit of an oval shape having a major axis extending in the cylinder arranging direction and a minor axis of a length substantially equal to a passage diameter of the merging passageways.

Thus the cylinder head can be given a low height with respect to a direction parallel to the axes of the cylinders, while ensuring smooth and easy outflow of the exhaust gas, and the capacity of the water jackets can be increased accordingly.

In a further preferred form of the present invention, partition walls are provided to separate the merging passageways adjacent to each other with respect to the cylinder arranging direction, the central collecting passageway has an exit of an oval shape having a major axis extending in the cylinder arranging direction, the major axis having a length greater than a distance between downstream ends of the partition walls at opposite ends with respect to the cylinder arranging direction among the partition walls.

Thus the central collecting passageway is made divergent in the cylinder arranging direction toward the downstream side, so that the exhaust gas can more easily flow out of the central collecting passageway through the exit with the height of the cylinder head in a direction parallet to the axes of the cylinders being suppressed to a minimum, than in a case wherein the exhaust gas flow simply into the exit of the central collecting passageway, while the influence of the flow of the exhaust gas flowing through the end individual exhaust passageways on the flow of the exhaust gas through the intermediate individual exhaust passageways is reduced, and the exhaust gas can easily flow out through the exit. Consequently, exhaust efficiency improves and engine output increases.

In a still further preferred form of the present invention, the central collecting passageway has an exit of an oval shape having a major axis extending in the cylinder arranging direction, the cylinder head has on an exhaust side thereof a side wall which has a plurality of fastening points for connecting an exhaust system thereto, and the fastening points are located at opposite sides of the oval exit with respect to both the cylinder arranging direction and a direction perpendicular to the cylinder arranging direction, wherein imaginary lines mutually connecting the fastening pointes on each of the opposite sides in the cylinder arranging direction are tangent to a periphery of the oval exit or intersects the oval exit.

Thus the exhaust gas from the individual exhaust passageways can easily outflow through the exit of the central collecting passageway while the height of the cylinder head in a direction parallel to the axes of the cylinders is suppressed to a minimum. Consequently, exhaust efficiency improves and engine output increases.

In this specification and claims accompanying the specification, a modifier "substantially" is used also for indicating qualities or states not modified by this modifier and for indicating qualities or states not having a significant difference in operation and effect from those not modified by this modifier.

DESCRIPTION OF THE PREFERRED EMBODIMENTS

A preferred embodiment of the present invention will be described with reference to FIGS. 1 to 3.

Figure 1:
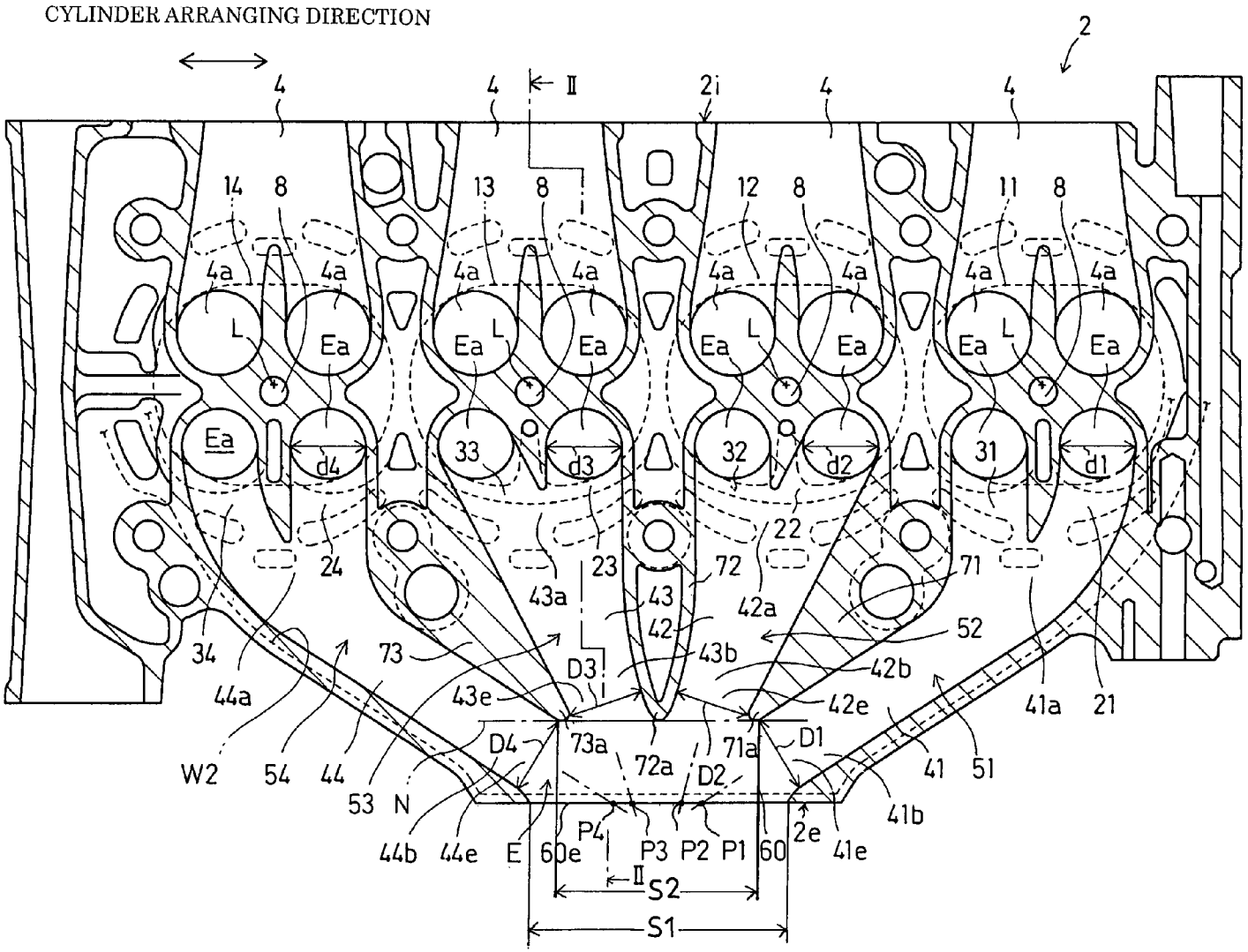
FIG. 1 is a sectional view, taken on the line I-I in FIG. 2, of a cylinder head of a multiple-cylinder internal combustion engine in a preferred embodiment of the present invention.
Figure 2:
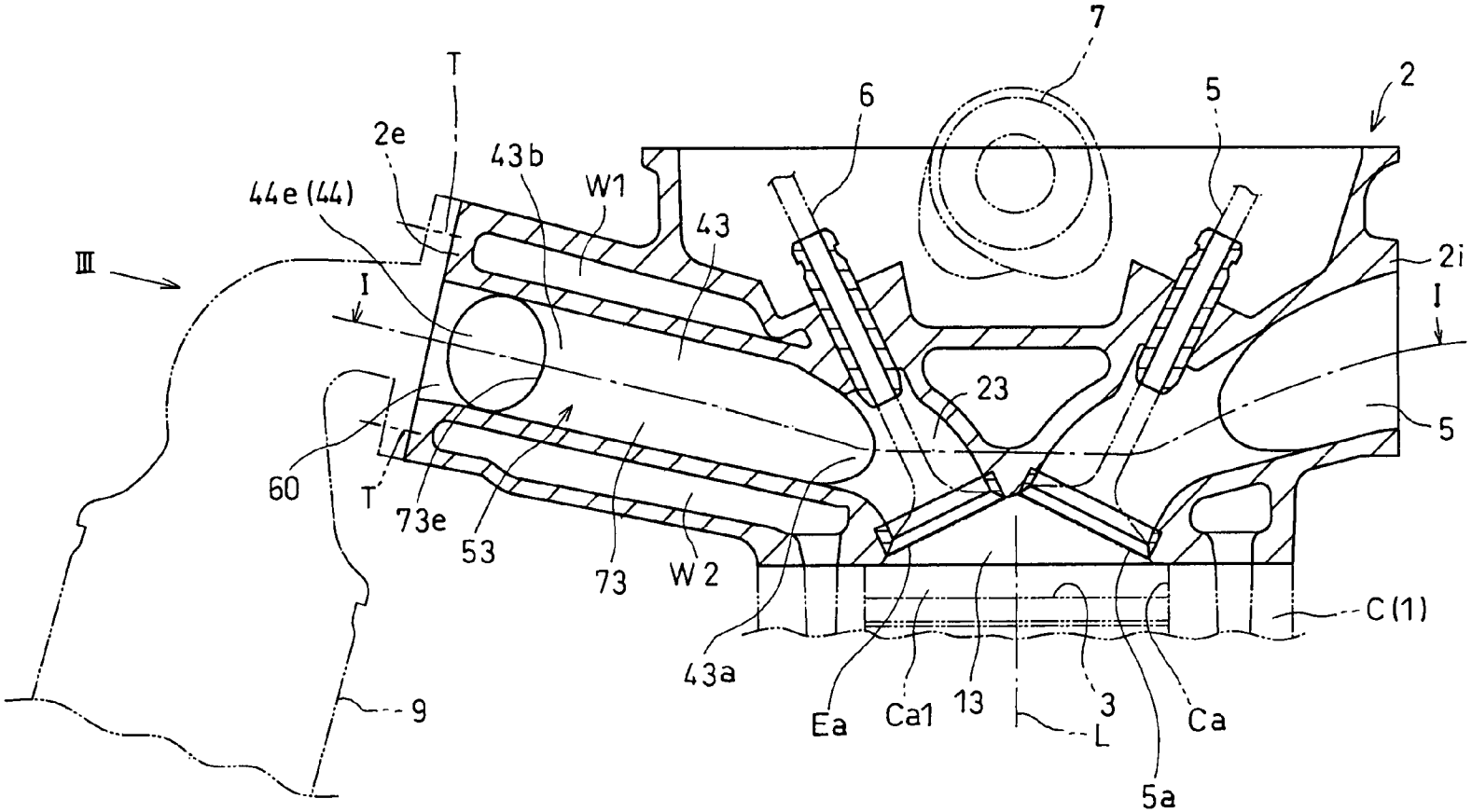
FIG. 2 is a sectional view taken on the line II-II in FIG. 1.

Referring to FIGS. 1 and 2, a multiple-cylinder internal combustion engine to which the present invention is applied has a predetermined number of cylinders C not less than two cylinders. The multiple-cylinder internal combustion engine is a water-cooled, four-cylinder, four-stroke engine having four cylinders C. Only one of the four cylinders C is shown in FIG. 2. The multiple-cylinder internal combustion engine is a transverse type internal combustion engine to be mounted on a vehicle with its crankshaft, not shown, extending along the width of the vehicle. The multiple-cylinder internal combustion engine (hereinafter, referred to simply as "internal combustion engine") has an engine body including a cylinder block 1 provided with the four cylinders C arranged in a row in a direction (hereinafter referred to as "cylinder arranging direction") and rotatably supporting the crankshaft, a cylinder head 2 joined to the upper end of the cylinder block 1, and a cylinder head cover, not shown, joined to the upper end of the cylinder head 2.

In this specification, the term "vertical directions" is used for indicating directions parallel to the axis L of each cylinder C (hereinafter, referred to as "cylinder axis directions") and the term "upward direction" is used to indicate a direction from the cylinder C toward the cylinder head 2.

A piston 3 is axially slidably fitted in the bore Ca of each cylinder C. Formed in the cylinder head 2 are recesses defining parts of combustion chambers 11 to 14 (only the combustion chamber 13 is shown in FIG. 2) and formed opposite, with respect to the cylinder axis direction, to the cylinder bores $C_a$, respectively, and a pair of intake ports 4*a* (inclusively designated by "4") opening into each of the recesses 11 to 14. Formed also in the cylinder head 2 is a centralized exhaust passageway E. The centralized exhaust passageway E includes individual exhaust passageways 51 to 54 each having a pair of exhaust ports $E_a$ opening into each of the recesses 11 to 14, and a central collecting passageway 60 for collecting the exhaust gas flowing through the individual exhaust passages 51 to 54.

The recesses 11 to 14 and bore parts Ca1 between the pistons 3 and the cylinder head 2 define combustion chambers, respectively. In the internal combustion engine, the four recesses 11 to 14 defining the combustion chambers respectively corresponding to the cylinders C are arranged in a row in the cylinder arranging direction.

The cylinder head 2 is provided with a pair of intake valves 5 for closing the pair of intake ports 4*a*, and a pair of exhaust valves 6 for closing the pair of exhaust ports Ea for each of the recesses 11 to 14 forming the combustion chambers. The intake valves 5 and the exhaust valves 6 are driven for opening and closing operation at predetermined times in synchronism with the rotation of the crankshaft by an overhead camshaft type valve train including a camshaft 7 rotatably supported on the cylinder head 2 and disposed in a valve chamber defined by the cylinder head 2 and the cylinder head cover.

An intake system includes a throttle valve, and an intake manifold connected to a side surface 2*i* in which passageways connected to the intake ports 4 open. An air-fuel mixture prepared by mixing air metered by the throttle valve and fuel injected by a fuel injection valve flows through the intake ports 4 into each of the combustion chambers defined by the recesses 11 to 14 when the intake valves 5 are opened. The air-fuel mixture supplied into the combustion chambers defined by the recesses 11 to 14 is ignited by spark plugs, not shown, respectively disposed in receiving tubes and inserted through plug holes 8 into the combustion chambers defined by the recesses 11 to 14. The reciprocation of the pistons 3 caused by the pressure of the combustion gas produced in the combustion chambers is transmitted by connecting rods to the crankshaft to drive the crankshaft for rotation.

The combustion gas is discharged through the exhaust ports Ea into the individual exhaust passageways 51 to 54 when the exhaust valves 6 are opened. The exhaust gas flows from the individual exhaust passageways 51 to 54 through the central collecting passageway 60 and outflows through the exit 60*e* of the central collecting passageway 60. The exhaust gas that has passed through the centralized exhaust passageway E flows through an exhaust system including a catalytic converter 9 attached to an exhaust-side side surface 2*e* of the cylinder head 2 and such and outflows from the internal combustion engine.

Referring to FIG. 1, the individual exhaust passageways 51 to 54 of the centralized exhaust passageway E collect the exhaust gas discharged from the combustion chambers defined by the recesses 11 to 14 in the cylinder head 2. Among the individual exhaust passageways 51 to 54, the passage way 51 is made up of two branch passageways 21 and 31 extending from the exhaust ports Ea opening into the combustion chamber defined by the recess 11, and a merging passageway 41 having one end connected to the two branch passageways 21 and 31 and the other end connected to the central collecting passageway 60. Similarly, the passage way 52 is made up of two branch passageways 22 and 32 and a merging passageway 42; the passage way 53 is made up of two branch passageways 23 and 33 and a merging passageway 43; and the passage way 54 is made up of two branch passageways 24 and 34 and a merging passageway 44.

The merging passageway 41 has an upstream end part 41*a* connected to the two branch passageways 21 and 31, and a downstream end part 41*b* having a downstream opening 41*e* and connected to the central collecting passageway 60. Similarly, the merging passageway 42 has an upstream end part 42*a* connected to the two branch passageways 22 and 32, and a downstream end part 42*b* having a downstream opening 42*e* and connected to the central collecting passageway 60; the merging passageway 43 has an upstream end part 43*a* connected to the two branch passageways 23 and 33, and a downstream end part 43*b* having a downstream opening 43*e* and connected to the central collecting passageway 60; and the merging passageway 44 has an upstream end part 44*a* connected to the two branch passageways 24 and 34, and a downstream end part 44*b* having a downstream opening 44*e* and connected to the central collecting passageway 60.

The respective passage diameters D1 to D4 of the downstream end part 41*b* to 44*b*, which are the smallest in passage diameter in the merging passageways 41 to 44, are substantially equal to any one of the passage diameters d1 to d4 of the two branch passageways 21 and 31, the two branch passageways 22 and 32, the two branch passageways 23 and 33, and the two branch passageways 24 and 34. For example, the passage diameters D1 to D4 are substantially equal to the port diameter of the exhaust port Ea. The respective passage diameters D1 to D4 of the downstream end part 41*b* to 44*b* are substantially equal. The merging passageways 41 to 44 extend straight to make the exhaust gas flow into the central collecting passageway 60 toward the exit 60*e* of the collecting passageway 60. The merging passageways 41 to 44 are extended so as to converge toward the elongated exit 60*e* parallel to the cylinder arranging direction and positioned so as to correspond to the middle of the arrangement of the four recesses 11 to 14 defining the combustion chambers. Thus, the straight merging passageways 41 to 44 serve to reduce the resistance against the flow of the exhaust gas. Since the straight merging passageways 41 to 44 of a small diameter are extended so as to converge toward and on the exit formed in the middle part of the side wall 2*i* on the exhaust side of the cylinder head 2, the cylinder head can be given a small size and the capacity of water jackets to be described later can be increased accordingly.

The respective sectional shapes of most parts of the two branch passageways 21 and 31, the two branch passageways 22 and 32, the two branch passageways 23 and 33, and the two branch passageways 24 and 34, and the merging passageways 41 to 44 excluding the upstream end parts 41*a* to 44*a* are substantially circular.

Sections of the passageways 21 to 24, 31 to 34 and 41 to 44 are those in planes perpendicular to the center axes of those passageways or directions in which main streams of the exhaust gas flow through those passageways. The downstream openings 41*e* to 44*e* are in sections of the merging passageways 41 to 44. The passage areas of the passageways 21 to 24, 31 to 34 and 41 to 44 are the sectional areas of the sections thereof, respectively.

Referring to FIGS. 1 and 2, partition walls 71, 72 and 73 are formed in the cylinder head 2. The merging passageways 41 and 42, the merging passageways 42 and 43, and the merging passageways 43 and 44 are separated by the partition walls 71, 72 and 73, respectively. Downstream ends 71*a*, 72*a* and 73*a* of the partition walls 71, 72 and 73 are arranged on a straight line N substantially parallel to the cylinder arranging direction in the vicinity of or adjacent to the exit 60*e* of the central collecting passageway 60, as viewed in a direction in which the axes of the cylinders extend, i.e., in plan view. An expression, the downstream ends 71*a*, 72*a* and 73*a* of the partition walls 71, 72 and 73 are arranged in the vicinity of or adjacent to the exit 60*e*, signifies a state where the maximum distances from the exit 60*e* respectively to the downstream ends 71*a*, 72*a* and 73*a* are substantially equal to or not greater than the passage diameters D1 to D4.

Thus the downstream openings 41*e* to 44*e* of the individual exhaust passageways 51 to 54 are positioned as near as possible to the exit 60*e* in a space extending between the combustion chambers defined by the recesses 11 to 14 and the exit 60*e*, so that the merging passageways 41 to 44 can be formed in as large lengths as possible, respectively. Therefore, exhaust gas interference can be effectively reduced even if the combustion chambers defined by the recesses 11 to 14, namely, the cylinders C, are successively arranged in ignition order and the exhaust periods in which the exhaust valves 6 are opened overlap each other.

The individual exhaust passageways 51 to 54 arranged in the cylinder arranging direction are a first end individual exhaust passageway 51 at one end of the row of the individual exhaust passageways 51 to 54, a second end individual exhaust passageway 54 at the other end of the row of the individual exhaust passageways 51 to 54, a first intermediate individual exhaust passageway 52 and a second intermediate individual exhaust passageway 53. The first intermediate individual exhaust passageway 52 and the second intermediate individual exhaust passageway 53 are arranged between the first end individual exhaust passageway 51 and the second end individual exhaust passageway 54. Extensions of the center axes of the merging passageways 41 and 44 of the individual exhaust passageways 51 and 54 intersect the exit 60*e* of the central collecting passageway 60 at intersection points P1 and P4, respectively. Extensions of the center axes of the merging passageways 42 and 43 of the individual exhaust passageways 52 and 53 intersect the exit 60*e* of the central collecting passageway 60 at intersection points P2 and P3, respectively. The intersection point P1 is nearer to the individual exhaust passageway 51 than the intersection points P2 and P3 with respect to the cylinder arranging direction. The intersection point P4 is nearer to the individual exhaust passageway 54 than the intersection points P2 and P3 with respect to the cylinder arranging direction. It will be understood that only one intermediate individual exhaust passageway is provided instead of two or more in the case of three-cylinder engine.

The passage diameters of a part extending from an area downstream from the upstream end part 41*a* to the downstream opening 41*e* and a part extending from an area downstream from the upstream end part 44*a* and the downstream opening 44*e* of the merging passageways 41 and 44 of the individual exhaust passageways 51 and 54 are substantially equal to the passage diameters D1 and D4, respectively. The respective passage areas of the individual exhaust passageways 52 and 53 decrease gradually from the upstream end parts 42*a* and 43*a* toward the downstream end parts 42*b* and 43*b*, so that the passage diameters of the individual exhaust passageways 52 and 53 also decrease gradually. Therefore, the partition wall 71 separating the individual exhaust passageways 51 and 52 adjacent to each other with respect to the cylinder arranging direction, the partition wall 73 separating the individual exhaust passageways 54 and 53 adjacent to each other with respect to the cylinder arranging direction can be given an increased length as compared with those of the known cylinder head in which the passage diameters of the merging passageways are greater than the passage diameters D1 to D4.

Figure 3:
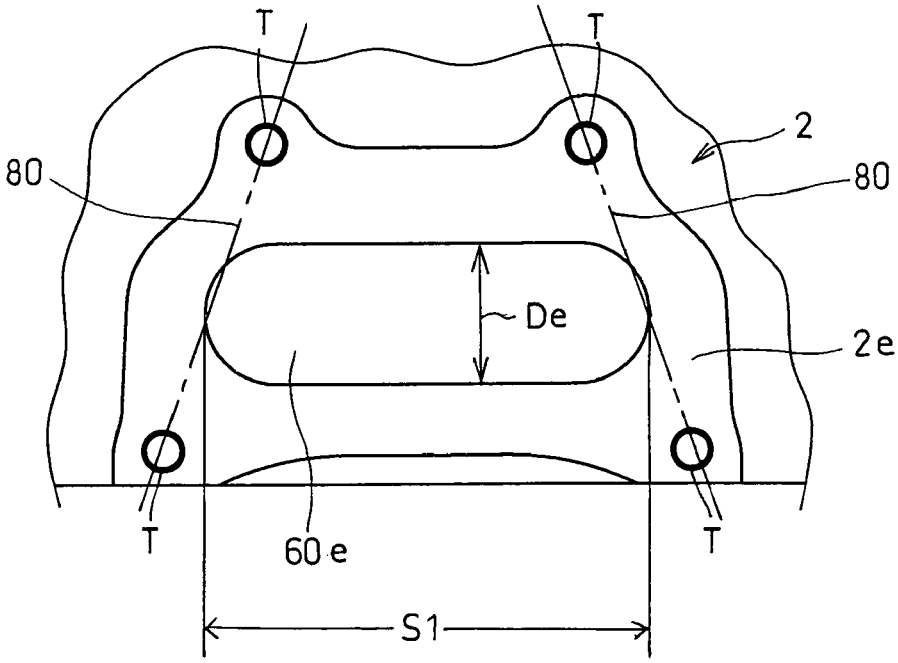
FIG. 3 is a view of a part of the cylinder head around the exit of a central exhaust passageway taken in the direction of the arrow III in FIG. 2.

As shown in FIG. 3, the exit 60*e* of the centralized exhaust passageway E has an oval shape in a plane as viewed in a direction perpendicular to the exit 60*e*. The exit 60*e* has a width (height) De or a length of a minor axis substantially equal to the passage diameters D1 to D4. According to this feature, the cylinder head 2 can be given a low height with respect to a direction parallel to the axes of the cylinders and the capacity of water jackets to be described later can be increased accordingly.

As shown in FIG. 1, the oval exit 60*e* of the central collecting passageway 60 has a major axis having a length S1 greater than a distance S2 between downstream ends of the partition walls 71 and 73 at opposite ends with respect to the cylinder arranging direction, among the partition walls 71, 72 and 73 partitioning the merging passageways 41, 42, 43 and 44. Thus the central collecting passageway 60 is made divergent toward the downstream side with respect to the cylinder arranging direction, so that the exhaust gas from the end individual passage ways 51 and 54 can more easily flow out of the central collecting passageway 60 through the exit 60*e* with the height of the cylinder head in a direction parallel to the axes of the cylinders suppressed to a minimum, than in a case wherein the exhaust gas simply flows into the exit 60*e* of the central collecting passageway 60, while the influence of the flow of the exhaust gas flowing through the end individual exhaust passageways 51 and 54 on the flow of the exhaust gas through the intermediate individual exhaust passageways 52 and 53 is reduced, and the exhaust gas can easily flow out through the exit 60*e*. Consequently, exhaust efficiency improves and engine output increases.

As shown in FIGS. 2 and 3, the cylinder head 2 has on an exhaust side thereof a side wall 2*a* through which the oval exit 60*e* of the central collecting passageway 60 is formed. The side wall 2*a* has a plurality of fastening points T for connecting an exhaust system 9 thereto, and the fastening points T are located at opposite sides of the oval exit 60*e* with respect to both the cylinder arranging direction and a direction perpendicular to the cylinder arranging direction. As shown in FIG. 3, imaginary lines 80 mutually connecting the fastening points T on the opposite sides with respect to the cylinder arranging direction are tangent to the periphery of the oval exit 60*e* or intersects the oval exit 60*e*. Thus the exhaust gas from the individual exhaust passageways 51, 52, 53 and 54 can easily outflow through the exit 60*e* of the central collecting passageway 60 with the height of the cylinder head in the direction parallel to the cylinder axes being suppressed to a minimum Consequently, exhaust efficiency improves and engine output increases.

Referring to FIGS. 1 and 2, an upper water jacket W1 and a lower water jacket W2 surround the merging passageways 41 to 44 and the central collecting passageway 60 from above and from below, respectively. Cooling water pumped by a water pump, not shown, flows through the water jackets W1 and W2 included in the cooling system of the internal combustion engine to cool the exhaust gas flowing through the centralized exhaust passageway E.

The operation and effect of the thus formed embodiment will be described.

As described above, the individual exhaust passageways 51 to 54 of the centralized exhaust passageway E formed in the cylinder head 2 have the two branch passageways 21,31;

22,32; 23,33, and 24,34 extending from the exhaust ports Ea opened and closed by the exhaust valves 6 and opening into the combustion chambers defined by the recesses 11; 12; 13 and 14, and the merging passageways 41; 42; 43 and 44 having the upstream ends 41*a*; 42*a*; 43*a* and 44*a* connected to the branch passageways 21,31; 22,32; 23,33, and 24,34. Further, the respective passage diameters D1 to D4 of the merging passages 41 to 44 of the individual exhaust passageways 51 to 54 are substantially equal to the respective passage diameters d1 to d4 of the two branch passageways 21,31; 22,32; 23,33 and 24,34. Furthermore, the upper water jacket W1 and the lower water jacket W2 surround the merging passageways 41 to 44 and the central collecting passageway 60 from above and from below, respectively. Thus, the respective passage diameters D1 to D4 of the merging passageways 41 to 44 are made small as compared with those of the known cylinder head, so that the capacities of the water jackets W1 and W2 surrounding the merging passageways 41 to 44 and the central collecting passageway 60 from above and from below can be increased without changing the height of the cylinder head 2. Since the distance between the center axis of each of the merging passageways 41 to 44 and the water jacket W1 and the distance between the center axis of each of the merging passageways 41 to 44 and the water jacket W2 can be made short, the inner portion of the exhaust gas flowing through central parts of the merging passageways 41 to 44 can be satisfactorily cooled. The partition walls 71, 72 and 73 for the merging passageways 41, 42, 43 and 44 can be given increased lengths, because the merging passageways 41 to 42 have the small diameters. Thus, cooling effect of the exhaust gas flowing through the merging passageways 41 to 44 can be promoted. Further, the capacities of the water jackets W1 and W2 can be increased without changing the height of the cylinder head 2 and the effect of cooling the exhaust gas flowing through the merging passageways 41 to 44 can be enhanced. Consequently, the efficiency of cooling the exhaust gas flowing out from the centralized exhaust passageway E is improved.

The downstream ends 71*a* to 73*a* of the partition walls 71 to 73 are arranged on the straight line N substantially parallel to the cylinder arranging direction in the vicinity of the exit 60*e* of the central collecting passageway 60, as viewed in plan view. Since all the partition walls 71 to 73 extend as near as possible to the exit 60*e* of the central collecting passageway 60, the merging passageways 41 to 44 can be given the largest possible lengths, respectively, and hence cooling effect of the exhaust gas flowing through the merging passageways 41 to 44 can be promoted. Since the downstream openings 41*e* to 44*e* are at largest distances from the combustion chambers defined by the recesses 11 to 14, respectively, exhaust gas interference is reduced. Thus the exhaust gas cooling effect of the merging passageways 41 to 44 is enhanced, the efficiency of cooling the exhaust gas flowing out from the centralized exhaust passageway E is improved and exhaust gas interference is reduced. Consequently, exhaust efficiency improves and engine output increases.

The intersection points P1 and P4 where extensions of the center axes of the end merging passageways 41 and 44 of the individual exhaust passageways 51 and 54 intersect the exit 60*e* of the central collecting passageway 60 are nearer to the individual exhaust passageways 51 and 54, respectively, than the intersection points P2 and P3 where extensions of the center axes of the intermediate merging passageways 42 and 43 of the individual exhaust passageways 52 and 53 intersect the exit 60*e* of the central collecting passageway 60 with respect to the cylinder arranging direction. Thus the exhaust gas flowing through the end individual exhaust passageways 51 and 54 can more easily outflow through the exit 60*e* than the exhaust gas outflows from the central collecting passageway 60 substantially along or parallel to the exit 60*e*, the influence of the flow of the exhaust gas flowing through the end individual exhaust passageways 51 and 54 on the flow of the exhaust gas flowing through the intermediate individual exhaust passageways 52 and 53 is reduced, and the exhaust gas can smoothly outflow through the exit 60*e*. Consequently, exhaust efficiency improves and engine output increases.

Changes that can be incorporated into the foregoing embodiment to provide modifications of the foregoing embodiment will be described.

The respective sectional shapes of the branch passageways and the merging passageways in the foregoing embodiment are substantially circular. When the sectional shapes are other than the substantially circular sectional shapes, the passage diameters of the passageways are those of passageways having circular sectional shapes and passage areas equal to those of the passageways having sectional shapes other than substantially circular sectional shapes.

Each of the individual exhaust passages may be branched into three of more branch passageways.

The internal combustion engine may be a multiple-cylinder V-type internal combustion engine having two banks each provided with a predetermined number of cylinders.

Although the internal combustion engine has been supposed to be an automotive internal combustion engine in the foregoing description, the internal combustion engine may be a marine engine, such as an outboard motor having a vertical crankshaft.

What is claimed is:

1. A multiple-cylinder internal combustion engine comprising:

a cylinder block provided with a predetermined number of cylinders not less than two cylinders arranged in a predetermined cylinder arranging direction; and a cylinder head attached to the cylinder block so as to form combustion chambers respectively corresponding to the cylinders, said cylinder head having exhaust ports respectively opening into the combustion chambers for being opened and closed by exhaust valves, respectively, individual exhaust passageways respectively connected to the exhaust ports such that the exhaust gas discharged through the exhaust ports flows through the individual exhaust passageways, and a central collecting passageway for collecting the exhaust gas from the individual exhaust passageways;

wherein each of the individual exhaust passageways has a plurality of branch passageways connected to the exhaust ports opening into the combustion chamber and to be opened and closed by the exhaust valves, and a merging passageway having an upstream end joined to the plurality of branch passageways, the merging passageway has a passage diameter substantially equal to that of the branch passageways, and the merging passageway and the central collecting passageway are surrounded by water jackets from above and below.

2. The multiple-cylinder internal combustion engine according to claim 1, comprising partition walls separating the merging passageways adjacent to each other with respect to the cylinder arranging direction, the partition walls having downstream ends at positions adjacent to an exit end of the central collecting passageway with respect to a direction parallel to axes of the cylinders, the downstream ends being arranged on a straight line parallel to the cylinder arranging direction.

3. The multiple-cylinder internal combustion engine according to claim 2 wherein the predetermined number of individual exhaust passageways include first and second end individual exhaust passageways at opposite ends, respectively, of the arrangement of the individual exhaust passageways, and at least one intermediate individual exhaust passageway arranged in the cylinder arranging direction between the first and second end individual exhaust passageways, and wherein points of intersection of extensions of center axes of the first and second end individual exhaust passageways and the exit end of the central collecting passageway are nearer to the first and second end individual exhaust passageways, respectively, than a point of intersection of an extension of center axis of the merging passageway of the at least one intermediate individual exhaust passageway and the exit end of the central collecting passageway with respect to the cylinder arranging direction.

* * * * *